United States Patent [19]

Perkins et al.

[11] 4,438,899

[45] Mar. 27, 1984

[54] TRANSPORT BRACKET FOR OUTBOARD MOTORS

[76] Inventors: Dale J. Perkins, 704 W. Grand; Leon L. Lincicum, 222 S. 2nd, both of Union, Oreg. 97883

[21] Appl. No.: 337,399

[22] Filed: Jan. 6, 1982

[51] Int. Cl.[3] ..... F16M 1/00

[52] U.S. Cl. ..... 248/642; 248/351

[58] Field of Search ..... 248/640, 641, 642, 643, 248/351; 440/900

[56] References Cited

U.S. PATENT DOCUMENTS

| | | | |
|---|---|---|---|
| 2,121,302 | 6/1938 | Robertson | 248/351 X |
| 2,939,670 | 6/1960 | Anderson | 248/351 |
| 4,331,431 | 5/1982 | Estes | 248/642 |

FOREIGN PATENT DOCUMENTS

| | | | |
|---|---|---|---|
| 250321 | 12/1963 | Australia | 108/132 |
| 402594 | 9/1968 | Australia | 108/132 |
| 955911 | 1/1957 | Fed. Rep. of Germany | 248/351 |

*Primary Examiner*—J. Franklin Foss

*Attorney, Agent, or Firm*—Bacon & Thomas

[57] ABSTRACT

A bracket for supporting an outboard motor in a tilted position, particularly where the motor is associated with a boat during transport on a trailer. The bracket is preferably of a substantially H-shaped configuration defined by a rod-shaped thrust member and a hollow cylinder-shaped pivot member disposed with their longitudinal axes in parallel and secured together in a spaced relationship to opposite ends of a bridging member. The pivot member is secured between the conventional tilt lock arms of the motor clamp by the existing locking pin. The first member is disposed against the conventional thrust surface of the motor frame and clamped thereagainst by the same existing lock mechanism which normally secures the locking pin to the thrust surface.

3 Claims, 4 Drawing Figures

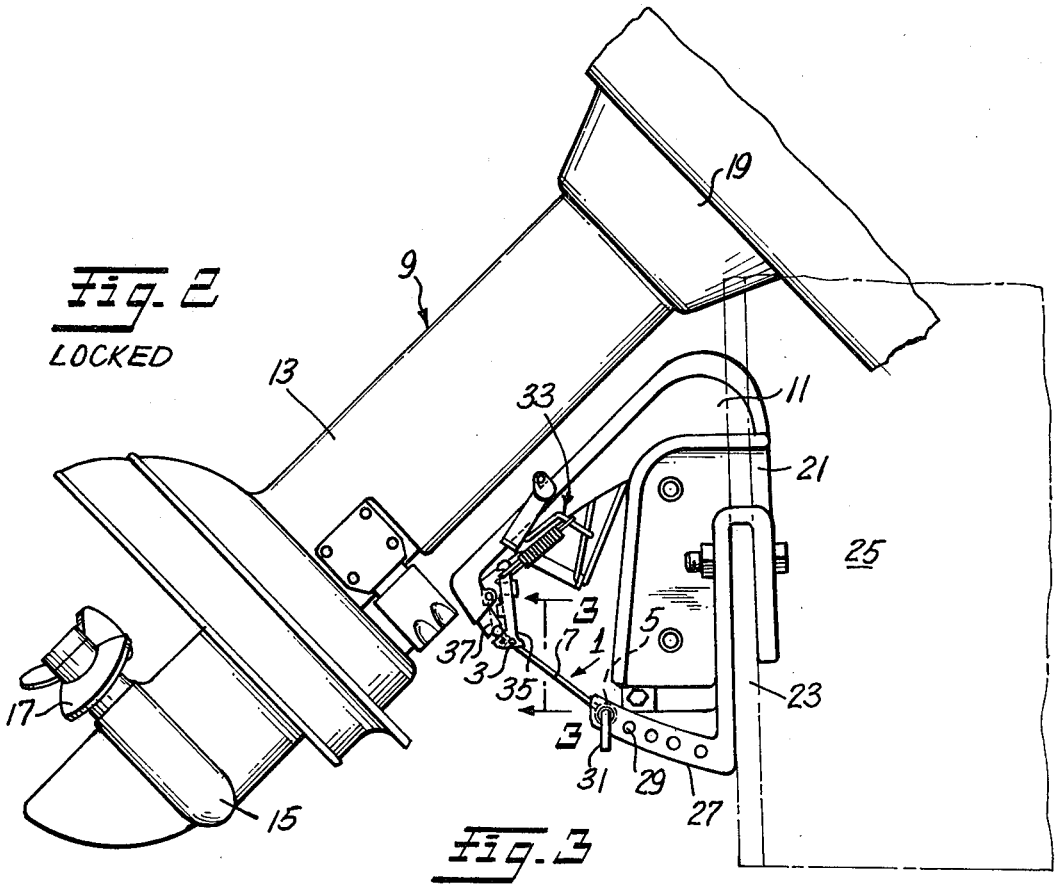
Fig. 2
LOCKED
Fig. 3
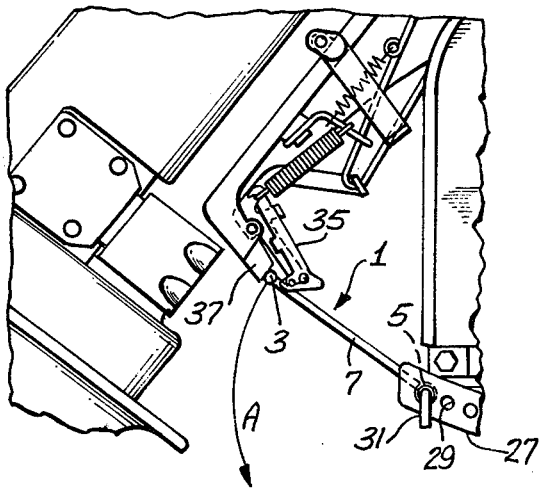
Fig. 4
UNLOCKED
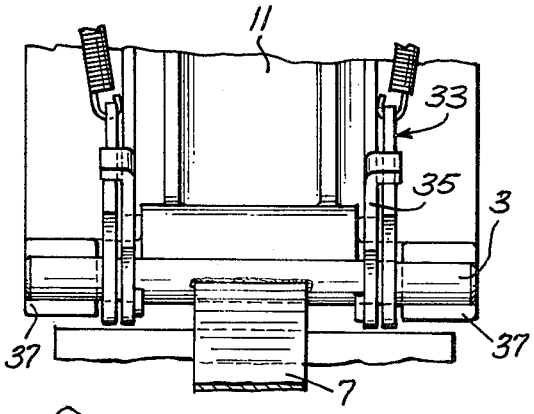
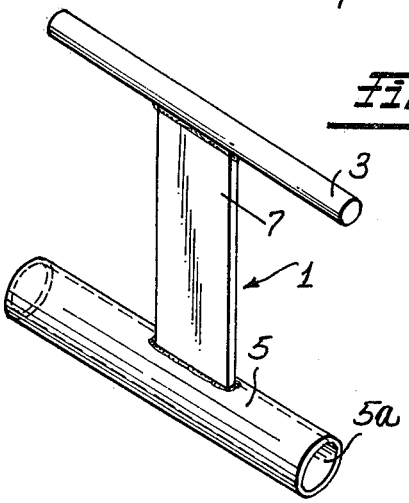
Fig. 1

TRANSPORT BRACKET FOR OUTBOARD MOTORS

BACKGROUND OF THE INVENTION

1. Field of the Prior Art

The present invention generally relates to outboard motors clamped onto the transom of the boat and 5 devices for maintaining such motors in an outwardly tilted position. More specifically, the invention comprises such devices as particularly used for securing an outboard motor in an outwardly tilted position when the motor and its associated boat are being transported on a trailer.

2. Description of the Prior Art

A conventional outboard motor includes a frame to which is attached a motor shaft housing. A gear box housing and associated propeller are carried at the lower end of the shaft housing and a superstructure which includes the motor or driving mechanism is carried at the upper end of the shaft housing. The frame is in turn pivotally connected to a clamping mechanism which serves to clamp the entire outboard motor to the transom disposed at the stern of a boat. Once an outboard motor is secured to the boat in this manner, it normally remains in this clamped position even when the boat is being transported on the ground by means of a trailer.

When an outboard motor is used for propelling a boat on water, the shaft housing is disposed in a substantially vertical position, with the propeller and associated gear box housing being submerged below the surface of the water to a depth that usually extends beyond the bottom surface of the boat. However, there are certain circumstances during operation when it is desirable to raise the propeller in order to prevent damage thereto when the boat is about to pass over an obstacle or very shallow waters. Such situations are accommodated by tilting the motor about the pivotal connection between the frame and clamp so that the propeller may be raised outwardly and upwardly with respect to the transom and maintained in a desired position of tilt. Various devices have been proposed by the prior art for accomplishing this procedure and are disclosed, for example, by the Rayniak U.S. Pat. No. 2,213,434; Watkins U.S. Pat. No. 2,583,910; Tromanhauser U.S. Pat. No. 2,822,999; and Larson U.S. Pat. No. 3,030,055.

In addition to the need for tilting an outboard motor during use on the water, the prior art has also proposed devices through which the motor may be maintained in a desired position of tilt when the motor and its associated boat are being transported on the ground by means of a trailer. Such devices are similar in function to the previously indicated devices, but are typically in the form of an elongate member secured at one end to the boat or trailer and provided with a yoke at the other end for engaging the motor. Examples of these devices are shown by the Holsclaw U.S. Pat. No. 2,901,267; Brown et al U.S. Pat. No. 2,977,084; Driscoll U.S. Pat. No. 3,693,576; Patterson U.S. Pat. No. 3,941,344; Wells U.S. Pat. No. 3,952,986; and Landwerlen U.S. Pat. No. 4,125,236.

Notwithstanding the state of the prior art in the field of technology to which the present invention pertains, there still exists a need for an outboard motor transport bracket which is simple in structure, economical to manufacture and capable of being utilized in conjunction with conventional outboard motors without the need for physical modification of the motor structure or special parts for accommodating the bracket to the existing motor structure.

SUMMARY OF THE INVENTION

It is an object of the present invention to provide an improved bracket for permitting the outward tilting of an outboard motor with respect to the transom of its associated boat in order to prevent damage to the motor.

It is another object of the invention to provide a transport bracket for an outboard motor which is simple in structure, economical to manufacture and reliable in use.

It is yet a further object of the invention to provide an improved outboard motor transport bracket which can be immediately used in conjunction with conventional outboard motors without the need for physical modification of the motor structure or special parts to adapt the bracket to the existing motor structure.

It is still another object of the invention to provide an improved bracket for permitting the outward tilting of an outboard motor in order to prevent damage to the motor during use on the water or when the motor is being transported on the ground.

These and other objects of the invention are realized by providing a transport bracket for an outboard motor wherein the bracket is of a substantially H-shaped configuration defined by a rod-shaped thrust member and a hollow cylindrical-shaped pivot member disposed with their longitudinal axes in parallel and secured together in a spaced relationship to opposite ends of a bridging member. In use, the pivot member is disposed between the existing tilt lock arms of a conventional outboard motor clamp and the locking pin is inserted through the aligned apertures of the lock arms and the pivot member, thereby permitting the bracket to pivot about the locking pin. The motor is pivoted upwardly and outwardly from the transom and the thrust member is disposed against the existing thrust surface provided on the frame of the motor. The thrust member is thereafter clamped in this position by engaging same with the existing spring-biased locking hooks which normally serve to engage the locking pin against the thrust surface. The degree of motor tilt may be varied through either lengthening the bridging member of the bracket or repositioning the locking pin if the tilt lock arms are provided with several pairs of adjustment holes.

The aforementioned and other objects of the invention will become apparent from the following description and appended claims, with reference being made to the accompanying drawings forming a part of the specification wherein like reference characters designate corresponding parts in the several views.

BRIEF DESCRIPTION OF THE DRAWINGS

FIG. 1 is an isometric view of a transport bracket according to a preferred embodiment of the invention;

FIG. 2 is a fragmentary side elevational view depicting the bracket of FIG. 1 in its locked position of use for transporting an outboard motor and its associated boat;

FIG. 3 is a fragmentary transverse sectional view, taken on the line 3—3 of FIG. 2 depicting an end view of the locking hooks; and FIG. 4 is a fragmentary side elevational view, on a larger scale, depicting the transport bracket of FIG. 2 in its unlocked position.

DETAILED DESCRIPTION OF THE PREFERRED EMBODIMENTS

A transport bracket 1 according to a preferred embodiment of the invention is shown if FIG. 1. Bracket 1 is comprised of a thrust member 3, preferably of a rod-shaped configuration, and a pivot member 5, preferably of a hollow cylindrical-shaped configuration having a longitudinal passageway 5a. Members 3 and 5 are secured together in a spaced relationship with their longitudinal axes being disposed substantially in parallel by means of a bridging member 7, preferably in the form of a single flat web having its opposite ends secured to the respective mid points of members 3 and 5. As is apparent from FIG. 1, thrust member 3 and pivot member 5 define the vertical legs and bridging member 7 defines the horizontal bar of an essentially H-shaped configuration.

Thrust member 3 is preferably made from a length of metal rod and pivot member 5 is preferably made from a length of hollow metal cylinder. Bridging member 7 may be of a flat metal strap that is welded at its opposite ends to the mid points of members 3 and 5. Preferred materials for making bracket 1 includes steel and aluminum, but any other materials deemed suitable for performing the intended function of bracket 1 may also utilized to advantage, including plastics and other synthetic or natural materials.

The manner in which bracket 1 is utilized shall now be described with particular reference to FIG. 2 wherein there is shown a conventional outboard motor 9 which includes a frame 11 secured to a shaft housing 13. The lower portion of housing 13 includes a gear box housing 15 and an associated propeller 17. The upper portion of housing 13 includes a superstructure housing 19 that encloses the driving mechanism (not shown), typically in the form of a gasoline or electric motor.

Frame 11 is pivotally connected to a clamp 21 which permits motor 9 to be rigidly secured to a transom 23 of a boat, generally indicated at 25. Clamp 21 includes a pair of identical spaced tilt lock arms 27, only one of which is shown in FIG. 2. Arms 27 include pairs of opposed and aligned spaced apertures 29 through which a locking pin 31 may be selectively inserted and secured. A lock mechanism 33 is attached to frame 1 and includes a pair of spaced spring-biased locking hooks 35, only one of which is shown in FIG. 2. Frame 11 also includes a pair of spaced thrust surfaces 37, only one of which is shown in FIG. 2, for engaging locking pin 31 which is secured thereagainst by locking hooks 35.

As further shown in FIG. 2, bracket 1 has been installed on motor 9 for the purpose of maintaining the latter in an outwardly and upwardly tilted position with respect to transom 23 in order to permit transporting boat 25 on a trailer and preventing possible damage to motor 9 through accidental contact of gear box housing 15 and propeller 17 with the ground surface or obstacles thereon. Bracket 1 is installed by disposing pivot member 5 between lock arms 27 so that the desired pair of aligned apertures 29 are placed in alignment with passageway 5a. Locking pin 31 is thereafter inserted through aligned apertures 29 and passageway 5a and secured in this position in any suitable conventional manner, such as providing cooperating threading on portions of pin 11 and in one or both aligned apertures 29. The inner diameter of passageway 5a is greater than the diameter of pin 31 in order to permit free pivotal movement of bracket 1 about pin 31. Thrust member 3 is then disposed against thrust surfaces 37 and lock mechanism 33 is actuated to dispose hooks 35 into locking engagement about thrust member 3 for the purpose of securing same against thrust surfaces 37. It is understood that lock mechanism 33 may be of any structural configuration well known in the art and capable of performing the required function as indicated herein.

With particular reference to FIG. 3, hooks 35 are shown in their engaged position against thrust member 3. A portion of bridging member 7 is also shown as extending downwardly towards pin 31. With reference to FIG. 4, hooks 35 are shown in their disengaged position, thereby permitting bracket 1 to be removed from thrust surfaces 37 by pivoting bracket 1 downwardly in the direction indicated by arrow A. Removal of bracket 1 from motor 9 is easily accomplished by merely disengaging pin 31 to free pivot member 5.

As is apparent, bracket 1 of this invention quickly and easily facilitates setting the tilt angle of an outboard motor with respect to the transom of its associated boat without the need of physically altering the motor or requiring special parts for adapting bracket 1 to the existing motor structure. The desired degree of tilt for motor 9 can be easily established by disposing locking pin 31 in a selected pair of aligned apertures 29. If lock arms 27 are provided with only one pair of aligned apertures 29, then the degree of tilt can be predetermined by varying the length of bridging member 7. Bracket 1 is easily adaptable for use with conventional outboard motors by merely varying the diameters and lengths of thrust member 5 and pivot member 7. Passageway 5a would of course be such a diameter so as to accommodate the given diameter of an existing locking pin 31.

The foregoing is considered as illustrative only of the principles of the invention and a preferred embodiment of the same. Numerous modifications and changes will readily occur to those skilled in the art and it is not desired to limit the invention to the exact construction and operation shown and described herein and accordingly all suitable modifications and equivalents may be resorted to within the scope of the invention.

We claim:

1. In an outboard motor pivotally connected to a clamp for securing the outboard motor to a transom of a boat, wherein the clamp includes a locking pin engageable through aligned apertures provided in a pair of spaced lock arms and the motor includes at least one thrust surface for engaging the locking pin, the improvement comprising means for maintaining the motor in a desired position of outward tilt with respect to the locking pin including:

(a) an elongate thrust member for engaging the thrust surface;

(b) a hollow cylindrical pivot member disposable between the spaced lock arms and of sufficient internal diameter for receiving the locking pin therethrough and permitting free pivotal movement of the pivot member about the locking pin;

(c) a bridging member including opposed ends secured to substantially the midpoints of the thrust and pivot members for defining a generally H-shaped configuration;

(d) the bridging member being of a substantially flat web-shaped configuration and of sufficient length for disposing the motor at an angle with respect to the vertical when the thrust member is engaged with the thrust surface; and (e) the pivot and thrust members being of substantially the same length.

2. The structure of claim 1 wherein the thrust, pivot and bridging members are all of metal.

3. The structure of claim 2 wherein the opposed ends of the bridging member are secured to the thrust end pivot members through welding.

* * * * *